US006079730A

United States Patent [19]

Mantel

[11] Patent Number: 6,079,730

[45] Date of Patent: Jun. 27, 2000

[54] PLATFORM FOR MOUNTING A SKI BINDING ON A SKI

[75] Inventor: Denis Mantel, Brignoud, France

[73] Assignee: Skis Rossignol S.A., Voiron, France

[21] Appl. No.: 09/116,516

[22] Filed: Jul. 16, 1998

[30] Foreign Application Priority Data

Jul. 22, 1997 [FR] France ..... 97 09535

[51] Int. Cl.[7] ..... A63C 11/26

[52] U.S. Cl. ..... 280/602; 280/607; 280/618

[58] Field of Search ..... 280/602, 607, 280/617, 618, 609, 610, 636

[56] References Cited

U.S. PATENT DOCUMENTS

| | | | |
|---|---|---|---|
| 4,842,293 | 6/1989 | Rochard | 280/607 X |
| 4,937,955 | 7/1990 | Bonaventure | 280/613 X |
| 4,961,591 | 10/1990 | Bejean et al. | 280/607 |
| 4,974,867 | 12/1990 | Rullier et al. | 280/607 |
| 5,026,086 | 6/1991 | Guers et al. | 280/86 |
| 5,393,086 | 2/1995 | Le Masson et al. | 280/602 |
| 5,431,427 | 7/1995 | Pieber et al. | 280/607 |
| 5,474,321 | 12/1995 | Pritz | 280/607 |
| 5,480,175 | 1/1996 | Astier et al. | 280/602 X |
| 5,538,271 | 7/1996 | Abondance | 280/602 |
| 5,671,939 | 9/1997 | Pineau | 280/602 |
| 5,671,940 | 9/1997 | Abondance | 280/602 |
| 5,813,688 | 8/1998 | Dacklin | 280/607 |
| 5,836,604 | 11/1998 | Piegay | 280/607 |

FOREIGN PATENT DOCUMENTS

| | | |
|---|---|---|
| 744195A | 11/1996 | European Pat. Off. . |
| 2638651 | 5/1990 | France . |
| 2656225A | 6/1991 | France . |
| 2718975 | 10/1995 | France . |

*Primary Examiner*—Michael Mar
*Attorney, Agent, or Firm*—Bugnion S.A.; John Moetteli

[57] ABSTRACT

The platform (1) comprises a rigid part (3) and an elastic part (4), the latter extending asymmetrically relative to the axis of the platform and continuously in a zone located above one of the edges (12) of the ski, which constitutes the outer edge of the ski, while the rigid part (3) is in direct contact with the ski on the side corresponding to the other edge (11), which constitutes the inner edge of the ski. A ski equipped in this way is less sensitive to edging mistakes.

8 Claims, 2 Drawing Sheets

PLATFORM FOR MOUNTING A SKI BINDING ON A SKI

FIELD OF THE INVENTION

The present invention relates to a platform for mounting a ski binding on a ski, comprising a rigid part, to which the ski binding is fixed, and an elastic part which is located between a portion of the rigid part and the ski, the rigid part having at least one zone in direct contact with the ski.

PRIOR ART

Patent FR 2 638 651 discloses a plat form consisting of a metal plate superimposed on a damping material, in particular a viscoelastic material, by which the platform is adhesively fixed to the ski. The ski binding is fixed to this platform by means of screws which do not enter the ski. This platform is intended to damp the transmission of impacts and vibrations from the ski to the skier and to prevent an excessively rigid connection between the skier and the ski from causing the edges to engage in the snow too much, which may cause unintentional braking. An unavoidable effect of this measure is to reduce the skier's sensitivity to the forces exerted on the edges, and consequently to reduce the accuracy with which the edges are set.

Utility certificate FR 2 718 975 discloses a platform which avoids the abovementioned drawback. In this platform, the lower face of the rigid upper part has projecting portions which pass through an elastic base to come into direct contact with the ski, so that the forces which the skier applies to the binding can be applied directly to the ski, and vice versa, so that the edges can be set well. For its part, the purpose of the elastic base is to absorb impacts. The bearing projections are distributed symmetrically on either side of the longitudinal symmetry axis of the platform.

Although also using a combination of a rigid material and an elastic material, the present invention has an object which is quite different. Its object is to obtain more secure and more comfortable behavior of the ski, and more precisely to ensure that the edges are set accurately when this is being done on the correct side of the ski, and to alleviate the effect in the event of an edging mistake, which makes it possible to reduce the incidence of falls both for a competitor and for an intermediate skier.

SUMMARY OF THE INVENTION

To this end, the platform according to the invention is one wherein the elastic part extends asymmetrically relative to the longitudinal mid-axis of the platform and continuously in a zone located above one of the edges of the ski, so that it constitutes a means of damping the forces exerted on said edge, which constitutes the outer edge of the ski, and wherein the zone of the rigid part of the platform which is in direct contact with the ski is located on the side corresponding to the other edge of the ski, which constitutes the inner edge of the ski when a turn is being made.

According to a preferred embodiment of the invention, the elastic part extends over about ⅔ of the width of the platform.

In order to ensure that the binding is stable when an edge is being set on the rigid side of the platform, the side corresponding to the inner edge of the ski, it is appropriate for the binding to be connected rigidly to the ski during this edge setting. However, in view of the length of the rigid part above the elastic part, the platform might under certain conditions flex slightly. In order to prevent this, the connection of the platform to the ski, on the side corresponding to the outer edge, is preferably a connection that is rigid in traction. This connection that is rigid in traction can be produced by the heads of the screws which hold the platform to the ski.

BRIEF DESCRIPTION OF THE DRAWINGS

The appended drawing represents an embodiment of the invention by way of example.

DESCRIPTION OF THE PREFERRED EMBODIMENT

Figure 1:
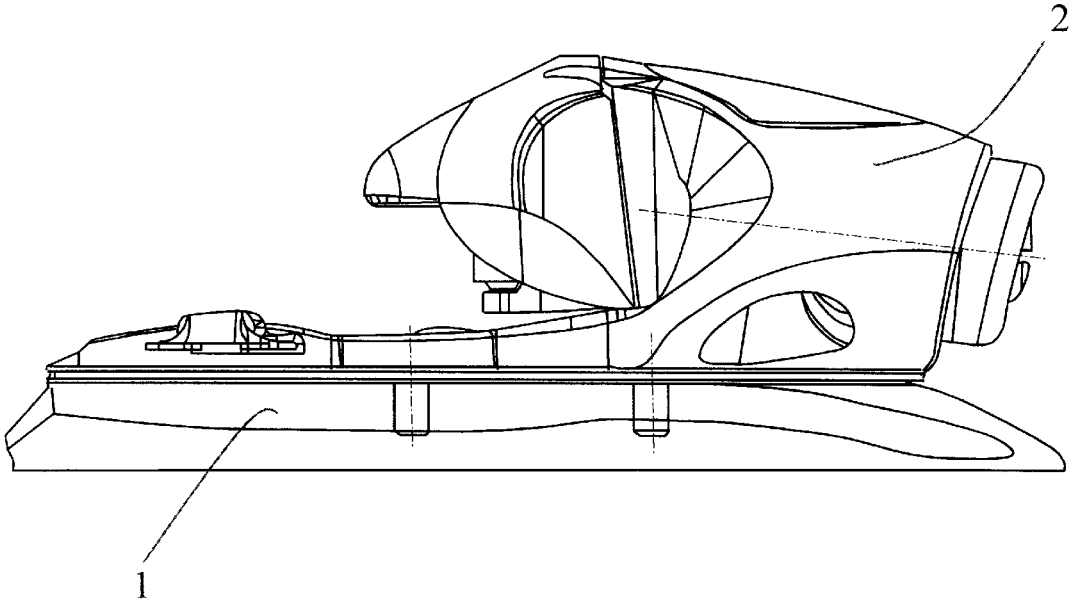
FIG. 1 is a side view of the platform which supports a binding 2.
Figure 2:
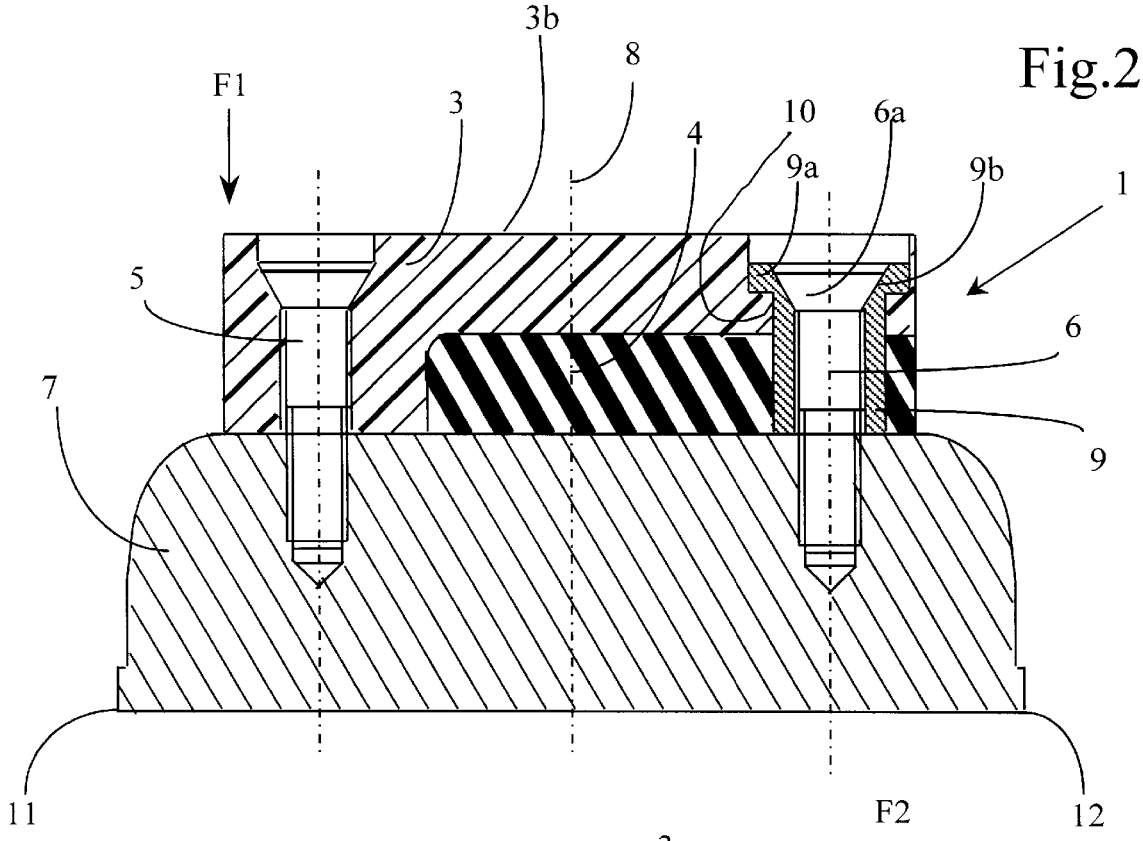
FIG. 2 is a cross-sectional view.

In FIG. 1, the platform 1 is represented with a binding 2 attached.

In a preferred embodiment This platform 1 consists of a rigid member 3 comprising a lower portion 3*a* and an upper portion 3*b*, the rigid member, for example made of rigid plastic, and an elastic part 4, for example made of rubber or the like, or even a viscoelastic material. The platform 1 is fixed to a ski 7 by means of at least two pairs of screws 5 and 6.

The elastic part 4 is in the form of a strip which extends asymmetrically relative to the longitudinal mid-axis of the platform, here coinciding with the axis of the ski, contained in the longitudinal vertical plane 8, over about ⅔ of the width of the platform 1, starting from one of the longitudinal sides of this platform. In the example in question, the elastic part 4 has a uniform thickness equal to about half of the total thickness of the platform.

In order to limit the pressure of the screws 6 on the rigid part 3, and to prevent a cantilever end 3' of the rigid part 3 from flexing, the effect of which would be to squash the elastic part 4, the screws 6 do not bear directly on the platform, but instead bear on a tubular insert 9 which is provided with a collar 9*a* pressing on the bottom of a countersunk hole 10 formed in the rigid part 3. The height of the inserts 9 is such that the flex ion force exerted on the rigid part 3 is insignificant. An embodiment without an insert is only theoretically possible, but would require special screws with limited penetration into the ski. The frustoconical heads 6*a* of the screws 6 bear in frustoconical entries 9*b* of the inserts.

On the side corresponding to the screws 5, the rigid part 3 of the platform is in direct contact with the ski 7 over a width corresponding to about ⅓ of the total width of the platform.

Since the platform 1 is asymmetric in terms of the rigidity with which it bears on the ski 7, its behavior will not be the same according to whether the skier exerts pressure on the ski edge 11 located on the side corresponding to the screws 5, or on the opposite edge 12. The ski therefore exhibits asymmetric behavior, which is precisely the desired effect.

The edge 11 will always be the inner edge of the ski, that is to say the one on which a turn should properly be taken. When an edge is set on the inner edge 11, the force is exerted on the corresponding side of the platform 1, as indicated by the arrow Fl. In this case, the forces between the edge 11 and the binding are transmitted only through the rigid parts, which ensures accurate edge setting and, in particular, in competition, accurate and reliable negotiation of turns.

Figure 3:
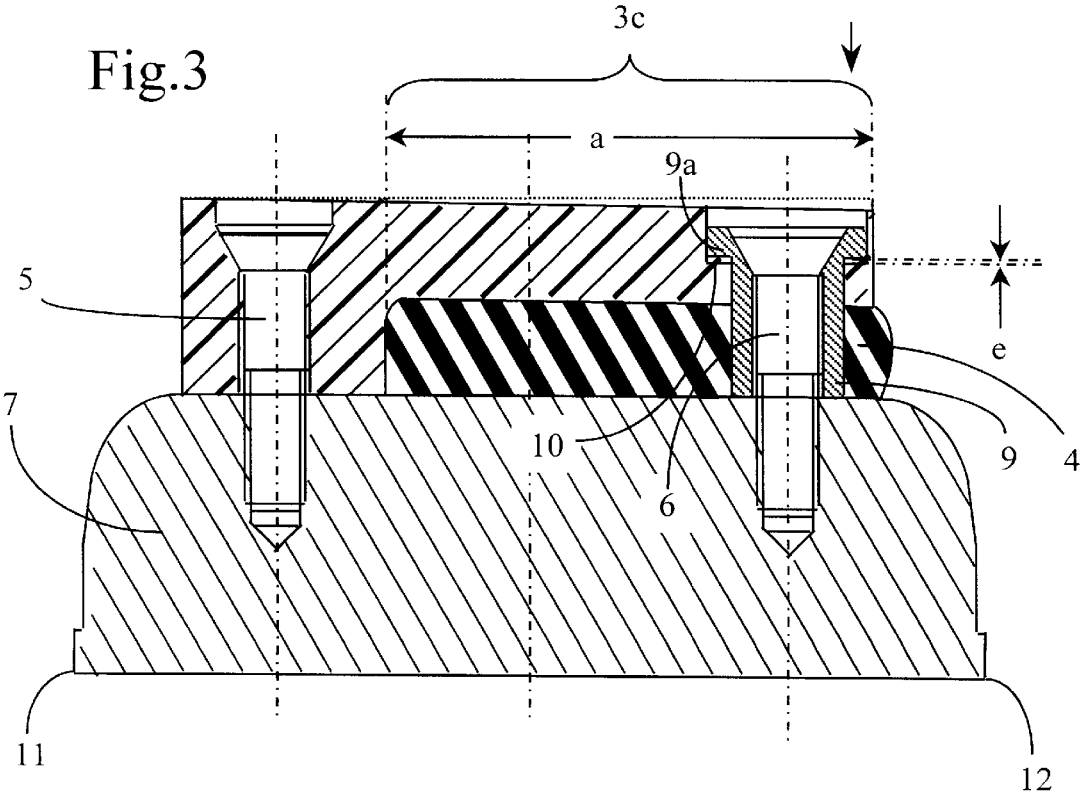
FIG. 3 is a sectional view, similar to the one in FIG. 2, showing how the platform behaves when an edge is being set incorrectly on the outer edge of the ski.

However, if the pressure is applied on the outer edge 12, as indicated by the arrow F2 in FIG. 3, the force is partly absorbed by the deformation of the elastic part 4, so that the edge will be set much less aggressively than on the inner edge 11. As already mentioned above, the portion a of the rigid part 3 which overhangs above the elastic part 4 allows the rigid part 3 to flex, as indicated by the space e between the insert 9 and the countersunk hole 10, which makes it possible to compress the elastic part 4. By virtue of the strong damping which results from this compression, an edging mistake will usually be without consequence. In particular, in competition, the competitor will be able to avoid going off course and will be capable of regaining his line.

When an edge is set correctly on the inner edge 11, the binding exerts traction on the opposite side of the platform 1. This traction tends to flex the part a upward and this could cause a feeling of instability. This kind of flexion is, however, prevented by the screws 6.

The skis cannot of course be interchanged, and must be marked left and right.

The elastic part could consist of several layers, some of which could be separated by a more or less rigid layer.

What is claimed is:

1. A platform for mounting a ski binding on a ski (7) having an inside turning edge, an outside turning edge, and a centerline, the platform comprising a rigid part **(3*a*) and a cantilivered end (3*c*) extending from an upper portion of the rigid part, the ski binding being fixed to the upper portion of the rigid part and an upper portion of the cantilevered end, the rigid part having a lower portion which attaches to the ski at points which lie to one side of the centerline and adjacent the inside turning edge of the ski, the cantilevered end extending from the upper portion of the rigid part to an opposite side of the centerline adjacent the outside turning edge of the ski and an elastic part (4) located between a lower portion of the cantilevered end and the ski, wherein the elastic part (4)** extends along the outside turning edge of the ski, so that the elastic part constitutes a means of dampening bending movement of the cantilevered end in a direction towards the ski.

2. The platform as claimed in claim 1, wherein the elastic part (4) extends over about ⅔ of the width of the platform.

3. The platform as claimed in claim 2, wherein the thickness of the elastic part (4) is about equal to half of the total thickness of the platform.

4. The platform as claimed in claim 1, wherein the lower portion on the side corresponding to the outer edge (12), is a connection which entends between the ski and the cantilevered end **(3*c*)** for preventing flexing of the cantilevered end in a direction extending away from the ski.

5. The platform as claimed in claim 4, wherein said connection consists of screws (6) whose heads form axial abutments for the rigid part of the platform (3).

6. The platform as claimed in claim 1, fixed to the ski by means of screws (5, 6), wherein, on the side corresponding to the elastic part (4), inserts (9) are arranged between the ski and the heads of the screws, so as to limit the pressure of the screws on the platform.

7. The platform as claimed in claim 1, wherein the elastic part consists of several layers.

8. A platform for mounting a ski binding on a ski (7) having an inside turning edge, an outside turning edge, and a centerline, the platform comprising a rigid part **(3*a*) and a cantilevered end (3*c*) extending from an upper portion of the rigid part, the ski binding being fixed to the upper portion of the rigid part and an upper portion of the cantilevered end, the rigid part having a lower portion which attaches to the ski at points which lie to one side of the centerline and adjacent the inside turning edge of the ski, tie cantilevered end extending from the upper portion of the rigid part to an opposite side of the centerline adjacent the outside turning edge of the ski, an elastic part (4) located between a lower portion of the cantilevered end and the ski, and fasteners for attaching the platform to the ski, the fasteners effectively preventing flexing of the cantilevered end when bending forces are exerted upon the cantilever end (3*c*) in a direction extending away from the ski while permitting flexing of the cantilever end (3*c*)** in a second direction towards the ski, the elastic member elastically supporting the cantilevered end and dampening any bending movement of the cantilevered end in the second direction.

* * * * *

UNITED STATES PATENT AND TRADEMARK OFFICE

CERTIFICATE OF CORRECTION

PATENT NO. : 6,079,730
DATED : JUNE 27, 2000
INVENTOR(S) : MANTEL

It is certified that error appears in the above-identified patent and that said Letters Patent is hereby corrected as shown below:

Col. 1, line 13, replace "plat form" by -platform--;

Col.2, line 21, replace "embodiment This" by -embodiment, this--;

Col. 2, line 43 replace "fle xion" by -flexion--.

Col. 3, line 34, add after "part" -across the center line--;

Col. 3, line 36, replace "ski" by -ski,--;

Col. 4 line 8, replace "entends" by -extends--;

Col. 4, line 28, replace "tie" by -the--;

Col. 4, line 29 add after "part" -across the center line--;

Col. 4 line 35 replace "cantilever" by -cantilevered--;

Col 4, line 35 add after "in a" -first--;

Col 4, line 37, replace "cantilever" by -cantilevered--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,079,730
DATED : June 27, 2000
INVENTOR(S) : Mantel

It is certified that error appears in the above-identified patent and that said Letters Patent is hereby corrected as shown below:

Column 1,
Line 13, replace "plat from" by -- platform --.

Column 2,
Line 21, replace "embodiment This" by -- embodiment, this --;
Line 43, replace "fle xion" by -- flexion --.

Column 3,
Line 34, add after "part" -- across the center line --;
Line 36, replace "ski" by -- ski, --;

Column 4,
Line 8, replace "entends" by -- extends --;
Line 28, replace "tie" by -- the --;
Line 29, add after "part" -- across the center line --;
Line 35, replace "cantilever" by -- cantilevered --;
Line 35, add after "in a" -- first --;
Line 37, replace "cantilever" by -- cantilevered --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*